US005971811A

United States Patent [19]

Mori et al.

[11] Patent Number: 5,971,811

[45] Date of Patent: Oct. 26, 1999

[54] SHIELDED CONNECTOR ADAPTED TO BE DIRECTLY ATTACHED TO AN APPARATUS

[75] Inventors: Shigeo Mori; Nobuaki Yoshioka, both of Shizuoka, Japan

[73] Assignee: Yazaki Corporation, Tokyo, Japan

[21] Appl. No.: 09/078,763

[22] Filed: May 15, 1998

[30] Foreign Application Priority Data

May 15, 1997 [JP] Japan ..... 9-125516

[51] Int. Cl.[6] ..... H01R 17/04

[52] U.S. Cl. ..... 439/675; 439/939

[58] Field of Search ..... 439/63, 607, 675, 439/939

[56] References Cited

U.S. PATENT DOCUMENTS 3,337,833 8/1967 Creedon ..... 439/939
4,743,205 5/1988 Mitani ..... 439/63
4,842,527 6/1989 Tellam ..... 439/63
5,718,592 2/1998 Hosler ..... 439/63

FOREIGN PATENT DOCUMENTS 658560 8/1994 Japan .

*Primary Examiner*—Neil Abrams
*Assistant Examiner*—Javaid Nasri
*Attorney, Agent, or Firm*—Suhrue, Mion, Zinn, Macpeak & Seas, PLLC

[57] ABSTRACT

In a shielded connector adapted to be directly attached to an apparatus, contact pieces bendingly project from a metal shell which is attached to a connector housing and surrounds a terminal housing portion. An elastic contact portion is disposed in each of the contact pieces. When a flange of the connector housing is attached to an electric apparatus, the elastic contact portion is compressively deformed in an elastic deformation amount range so as to be pressingly contacted with an electrically conductive casing of the electric apparatus, whereby the contact pressure between the contact pieces and the casing is held.

5 Claims, 8 Drawing Sheets

SHIELDED CONNECTOR ADAPTED TO BE DIRECTLY ATTACHED TO AN APPARATUS

BACKGROUND OF THE INVENTION

The invention relates to a shielded connector which can be directly attached to various electric apparatuses such as a power motor.

Conventionally, it is proposed to form a shielded connector which can be directly attached to various electric apparatuses, by integrally molding a metal shell on a connector housing made of a synthetic resin.

An example of a shielded connector A of the integrally molded type will be described with reference to FIG. 6. The shielded connector A comprises a terminal piece 2 which is to be crimped to a terminal of a shielded wire 1, and a connector housing 4 on which a metal shell 3 is integrally molded (see, for example, Japanese Utility Model Unexamined Publication No. Hei. 6-58560).

A connecting member 5 is attached to a braided shield portion 1*b* which is exposed by peeling off an outer covering layer 1*a* of the shielded wire 1. A core wire (conductor) 1*d* which is exposed by peeling off an inner covering layer 1*c* of the shielded wire 1 is inserted into a bottomed hole 2*a* formed in one side of the conductive terminal piece 2, and then pressingly fitted by crimping.

The connector housing 4 comprises a cylindrical portion 4*a* and a flange 4*b*. The metal shell 3 is embedded between the cylindrical portion and the flange. The terminal piece 2 is inserted into the cylindrical portion 4*a*.

When the flange 4*b* is fastened to a metal casing 6 of an electric apparatus by bolts 7, the shield portion 1*b* is connected with the metal casing 6 through the connecting member 5 and the metal shell 3, thereby establishing a grounding connection.

A bolt 10 passed through an apparatus terminal 8 to which an electric wire 9 is connected is screwed with a thread hole formed in the other side of the terminal piece 2, thereby electrically connecting the apparatus terminal 8 with the terminal piece.

In the thus configured shielded connector A of the integrally molded type, it is difficult to perform a process of improving conformability between the connector housing 4 made of a synthetic resin and the metal shell 3. Therefore, there arises a problem that when a gap is formed between the synthetic resin material and the metal, the shield effect cannot be ensured.

A method in which a synthetic resin material is metal plated may be employed. However, this countermeasure has a problem in that a process of plating a synthetic resin material requires a very high production cost.

FIG. 7 is a longitudinal section view of a shielded connector A, which is adapted to be directly attached to an apparatus and which can be produced at a low cost and attain the shield effect, and FIG. 8 is a perspective view showing main parts of the connector. In the shielded connector $A_1$, a metal shell 12 is incorporated into a connector housing 11, and the connector housing 11 is directly mounted on (directly attached to) an electrically conductive casing 13 of an electric apparatus such as a motor.

In the connector housing 11, a flange 15 which is to be attached to the casing 13 is formed around one end of a busing 14 which receives an outer cylindrical portion of a counter connector. A bolt insertion hole 16 is formed at the four corners of the flange 15.

A terminal housing portion 17 is disposed in a substantially center area of the flange 15 and in the busing 14. The metal shell 12 is attached to a groove 20 formed in the outer periphery of the terminal housing portion 17. A contact piece 18 bendingly projects from an end portion of the metal shell 12.

In the terminal housing portion 17, a terminal piece 19 is housed on the inner peripheral face which opens at both the ends. Although not shown, the terminal piece 19 and the metal shell 12 are connected with a terminal and a shield member of the counter connector, respectively.

When the flange 15 is fastened to the casing 13 by means of bolts which are passed through the bolt insertion holes 16 and holes 21 of the casing 13, the contact piece 18 is pressingly contacted with the casing 13, thereby establishing an electrical connection therebetween.

The contact piece 18 is inclined so that the tip end portion is closer to the casing 13. When the flange 15 and the casing 13 are fastened together, therefore, the tip end portion of the contact piece 18 accompanied by a resilient force is pressingly contacted with the casing 13. In order to enhance the contact pressure of the contact piece 18, an electrically conductive contact member 22 is inserted between the contact piece 18 and the flange 15.

Reference numeral 23 designates an O-ring, and 24 designates a packing.

Since the contact piece 18 has a shape in which the piece bendingly projects from the end portion of the metal shell 12, the piece is poor in rigidity. When the flange 15 and the casing 13 are fastened together and the tip end portion of the contact piece 18 is kept to be pressingly contacted with the casing 13 for a long time period, the piece is plastically deformed and its elasticity is lost, with the result that the resilient contact force against the casing 13 is gradually lowered. Therefore, the contact stability cannot be expected.

When the casing 13 and the flange 15 are detached from each other for inspection or the like and the connector is then reassembled, the contact piece 18 is contacted with the casing under a state where the original resilient force is lost, so that the reliability of the electrical connection is lowered.

In order to prevent the resilient force of the contact piece 18 from being lowered, the size of the contact piece 18 has been modified, and the material of the metal shell 12 has been changed. However, such countermeasures have problems in that the shielded connector $A_1$ cannot be made compact so that the desire for a more compact connector can not be met and the production cost is increased.

SUMMARY OF THE INVENTION

It is an object of the invention to solve the above-discussed problems and provide a shielded connector adapted to be directly attached to an apparatus in which the resilient force of a contact piece can be held without increasing the size of the contact piece, changing the material to an expensive one, and increasing the number of parts of the shielded connector.

In order to attain the object, according to the invention, in a shielded connector adapted to be directly attached to an apparatus, in which a metal shell for shielding which surrounds a terminal housing portion is disposed in a connector housing in which the terminal housing portion is disposed, a contact piece bendingly projects and elongates from the metal shell, and, when the connector housing is directly attached to an electric apparatus, the contact piece is pressed by an electrically conductive casing of the electric apparatus, thereby establishing an electrical connection, the contact piece has an elastic contact portion, a housing recess is disposed in at least one of overlapping faces of the connector housing and the electrically conductive casing, and the housing recess has a depth sufficient for housing the contact piece in which the elastic contact portion is compressively deformed in an elastically returnable range, whereby, when the connector housing is directly attached to the electric apparatus, the elastic contact portion is pressingly contacted with the electrically conductive casing by compressive deformation which is elastically returnable.

The elastic contact portion may be a drawn product which is plastically deformed by applying a drawing process on the contact piece, or a spring piece which is disposed in the contact piece.

When the elastic contact portion is a spring piece, the contact piece may be a plate spring having a bent portion which is formed in a middle portion.

DETAILED DESCRIPTION OF THE INVENTION

Figure 1:
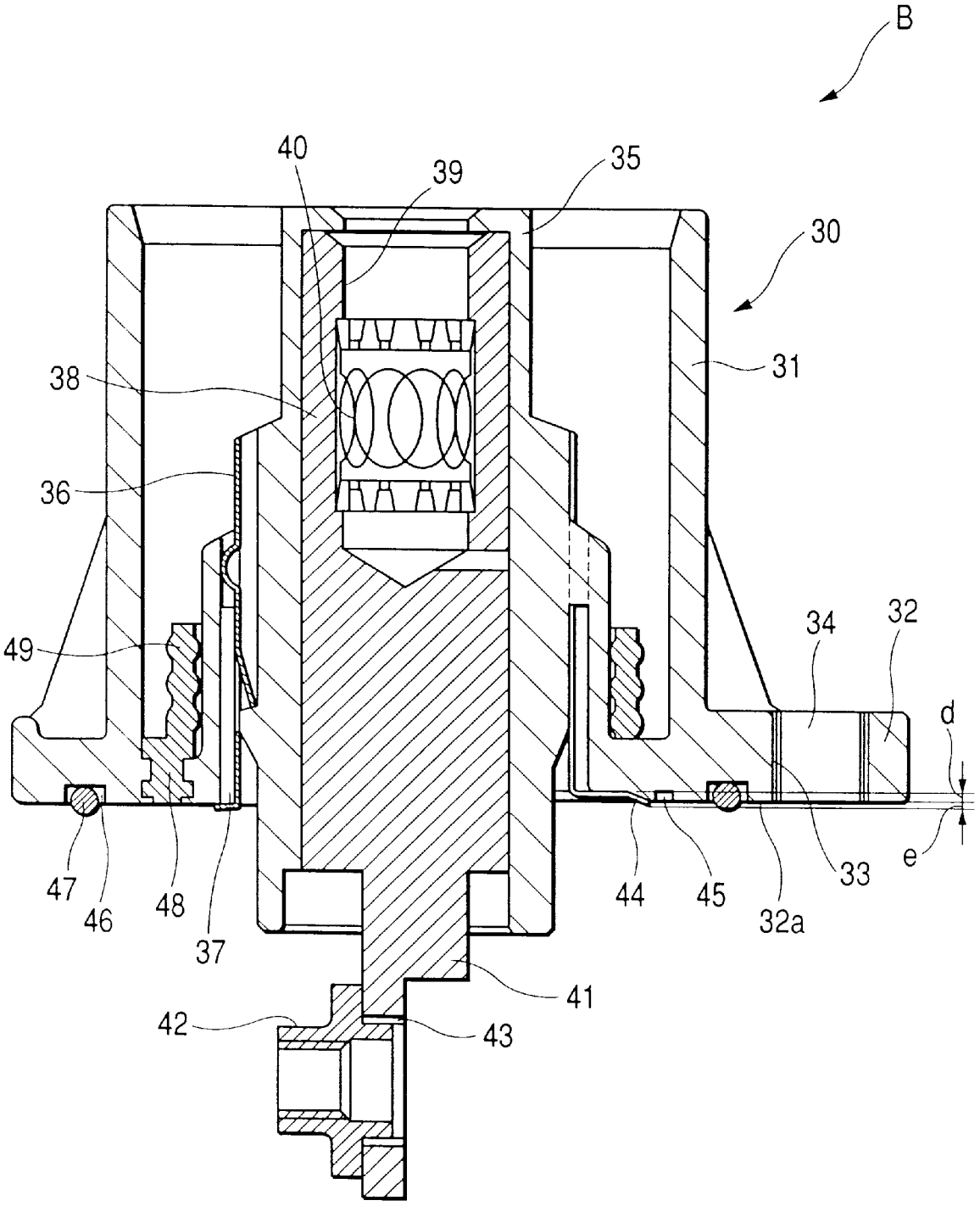
FIG. 1 is a longitudinal section view of a shielded connector adapted to be directly attached to an apparatus according to a first embodiment of the invention.
Figure 2:
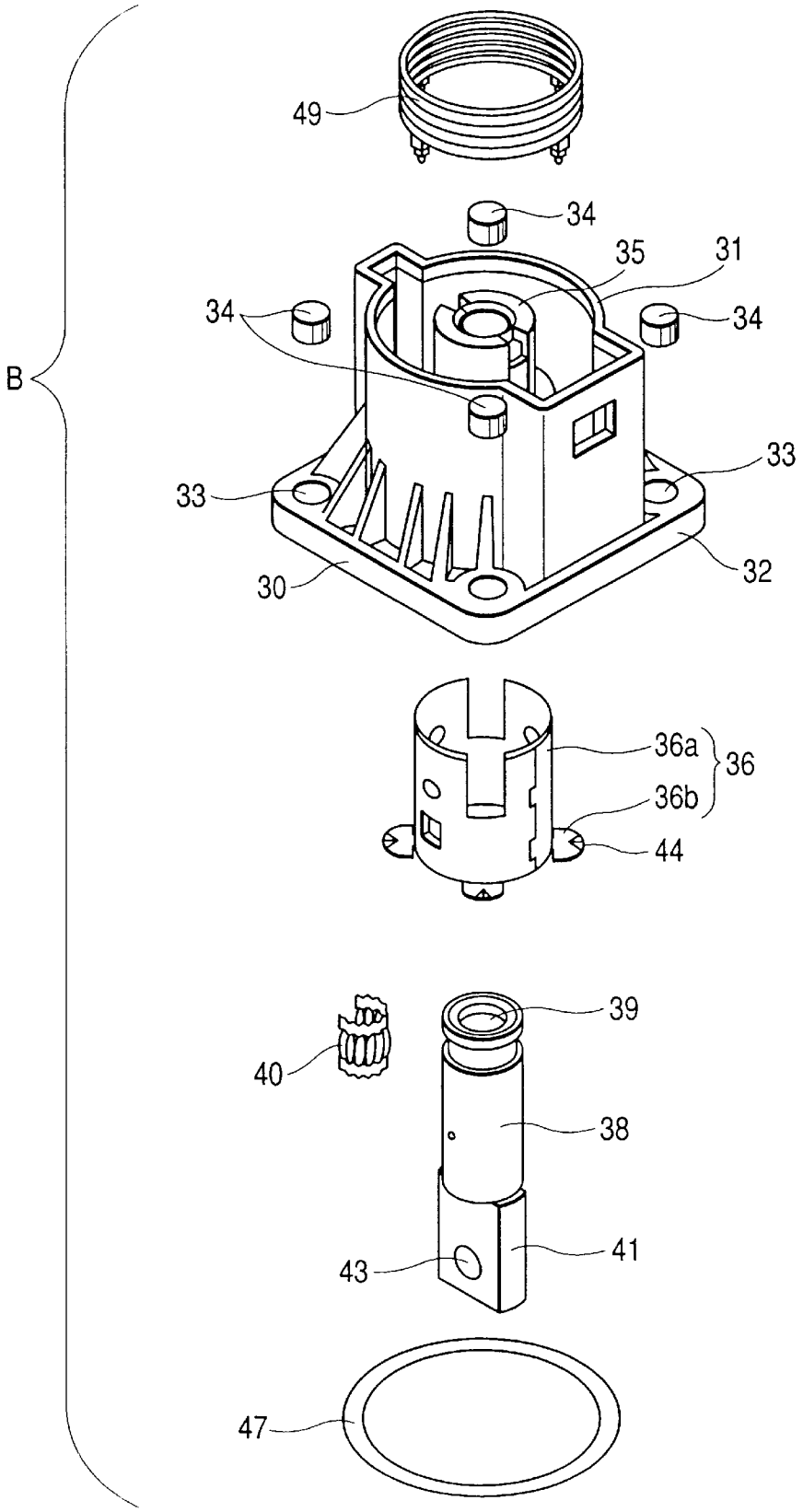
FIG. 2 is an exploded perspective view of the shielded connector adapted to be directly attached to an apparatus according to the first embodiment.

Preferred embodiments of the invention will be described with reference to the accompanying drawings. FIG. 1 is a longitudinal section view of a shielded connector B adapted to be directly attached to an apparatus according to a first embodiment of the invention, and FIG. 2 is an exploded perspective view of the shielded connector B adapted to be directly attached to an apparatus.

As shown in FIG. 1, in a connector housing 30 of the shielded connector B, a flange 32 is formed around one end of a busing 31 which receives an outer cylindrical portion of a counter connector.

A mounting hole 33 is opened at the four corners of the flange 32. A collar 34 is inserted into each of the mounting holes 33. A cylindrical terminal housing portion 35 is disposed in a substantially center area of the flange 32. A groove 37 into which a metal shell 36 is inserted is formed in the outer periphery of the terminal housing portion 35.

The terminal housing portion 35 opens at both the ends. A terminal piece 38 is housed in the terminal housing portion.

A bottom hole 39 is formed in one end (in FIG. 1, the upper end) of the terminal piece 38. A spring piece 40 is disposed on the inner wall of the bottomed hole 39. The spring piece 40 is pressingly contacted with a counter terminal which is to be inserted into the bottomed hole 39.

A plate-like portion 41 is formed at the other end of the terminal piece 38, and a thread hole 43 to which a terminal 42 of the apparatus is attached is formed in the plate-like portion 41 (see FIGS. 1 and 2).

The metal shell 36 is formed by working a metal plate which is electrically conductive and has elasticity, and is constituted by a cylindrical portion 36*a* having a cylindrical shape, and four contact pieces 36*b* which bendingly project from the lower end of the cylindrical portion 36*a*.

An elastic contact portion 44 which is disposed at the tip end of each of the contact pieces 36*b* is a drawn product which is subjected to a drawing process by using a mold die of a pressing machine so that the lower face is concave and the upper face opposite to the lower face is convex. The tip end of the elastic contact portion 44 is slightly downward inclined (see FIG. 1).

The lower face of the flange 32 of the connector housing 30 serves as an overlapping face 32*a* which overlaps with a casing 13 of an electric apparatus. A housing recess 45 which communicates with the groove 37 is formed in the face, an annular ring groove 46 is formed outside the housing recess 45, and an O-ring 47 is inserted into the ring groove 46.

In the flange 32, a packing groove 48 is formed between the busing 31 and the terminal housing portion 35. A packing 49 is inserted into the packing groove 48.

In FIG. 1, the housing recess 45 is disposed in the overlapping face 32*a* of the flange 32. Alternatively, the housing recess may be disposed in the overlapping face of the casing 13 instead of the flange 32 (in the alternative, the housing recess is configured in the same manner as a housing recess 45' of FIG. 4).

When the cylindrical portion 36*a* of the metal shell 36 is inserted into the groove 37, the contact pieces 36*b* of the metal shell 36 are housed in the housing recess 45 having a depth d, and the tip end of the elastic contact portion 44 of each contact piece 36*b* projects from the overlapping face 32*a* of the flange 32 of the connector housing 30 by a dimension e (see FIG. 1).

The projection dimension e is set to be smaller than the amount by which the elastic contact portion 44 is elastically compressively deformed. Even when the whole of the contact pieces 36*b* enters the interior of the housing recess 45, therefore, permanent set is not produced in the elastic contact portion 44.

Figure 3:
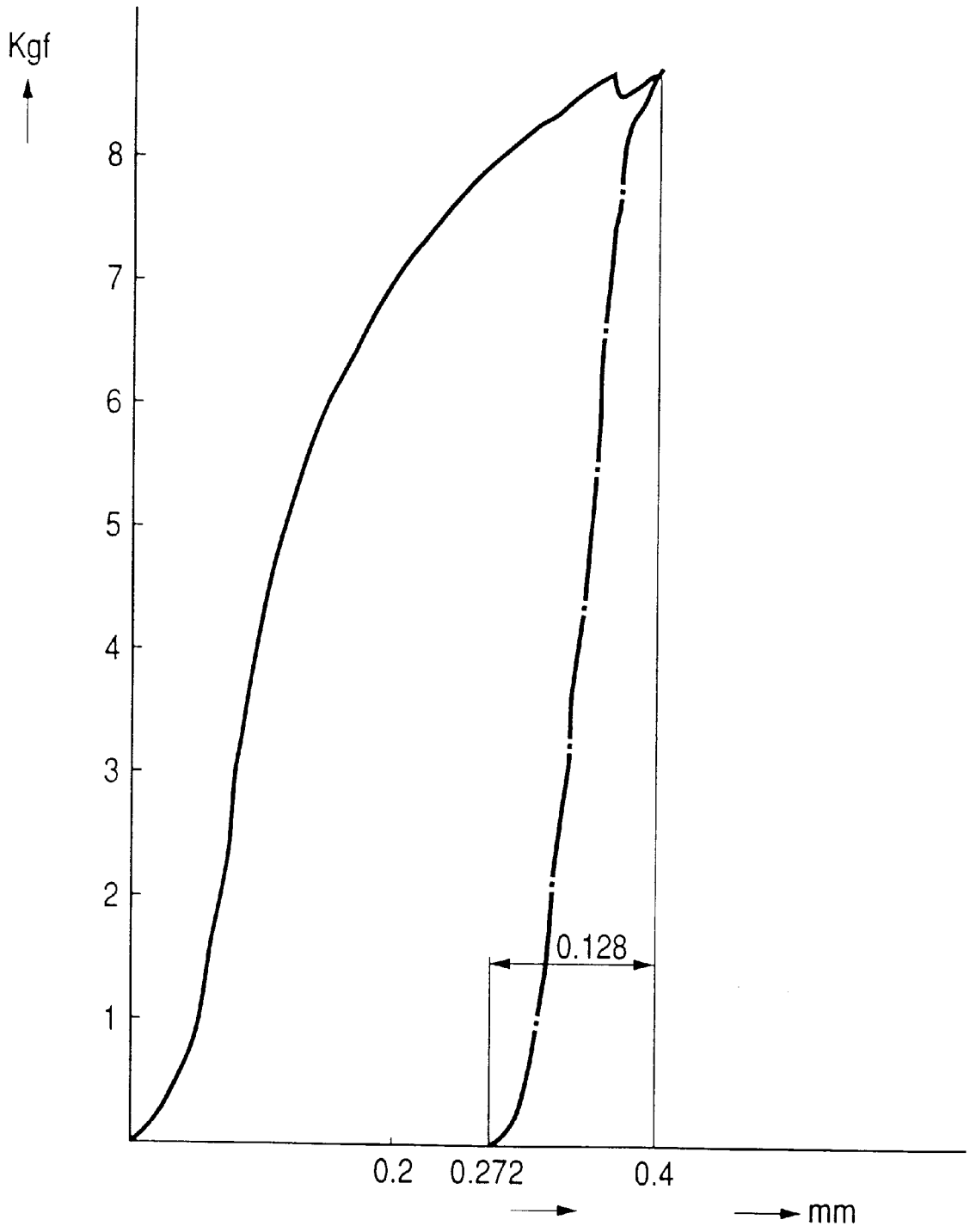
FIG. 3 is a "load/deformation amount" graph of an elastic contact portion of a contact piece of the shielded connector adapted to be directly attached to an apparatus according to the first embodiment.

FIG. 3 is a "load/deformation amount" graph showing results of experiments in which a load was applied until the elastic contact portion 44 was flush with the contact pieces 36*b*. The ordinate indicates the load (kgf) applied to the elastic contact portion 44, and the abscissa the deformation amount (mm) of the elastic contact portion 44. When a load is applied until the elastic contact portion 44 in which the recess has a depth of 0.4 mm is deformed to be flat (see the solid line), the load is 8.6 kgf. When this load is released (see the chain line), the amount of permanent set is 0.272 mm and the remainder of 0.128 mm equals to the amount of elastic return.

From the above, it was confirmed that, even when large deformation which may cause permanent set is produced, the elastic contact portion 44 remains to have an elastic returning force of a considerable degree.

In the invention, the projection dimension e of the elastic contact portion 44 is limited to the elastically deformable range. Therefore, the contact pressure exerted between the shielded connector B and the casing 13 is prevented for a long period of time from being lowered, and, even when the connector is disassembled and reassembled, the shield property is surely held.

In the embodiment described above, the housing recess 45 is disposed in the overlapping face 32*a* of the flange 32. Alternatively, the recess may be disposed in the overlapping face of the casing 13.

Figure 4:
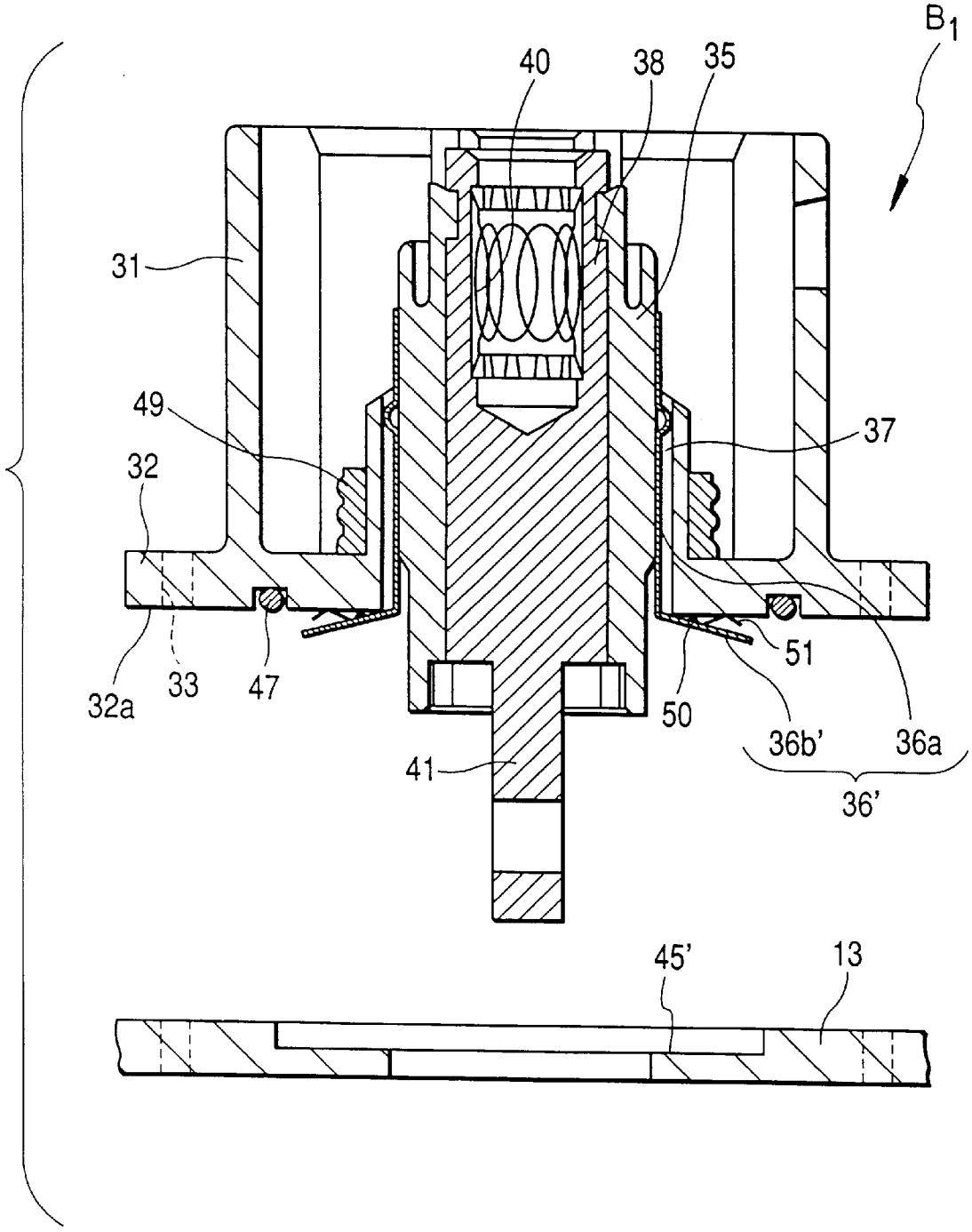
FIG. 4 is a longitudinal section view of a shielded connector adapted to be directly attached to an apparatus according to a second embodiment of the invention.
Figure 5:
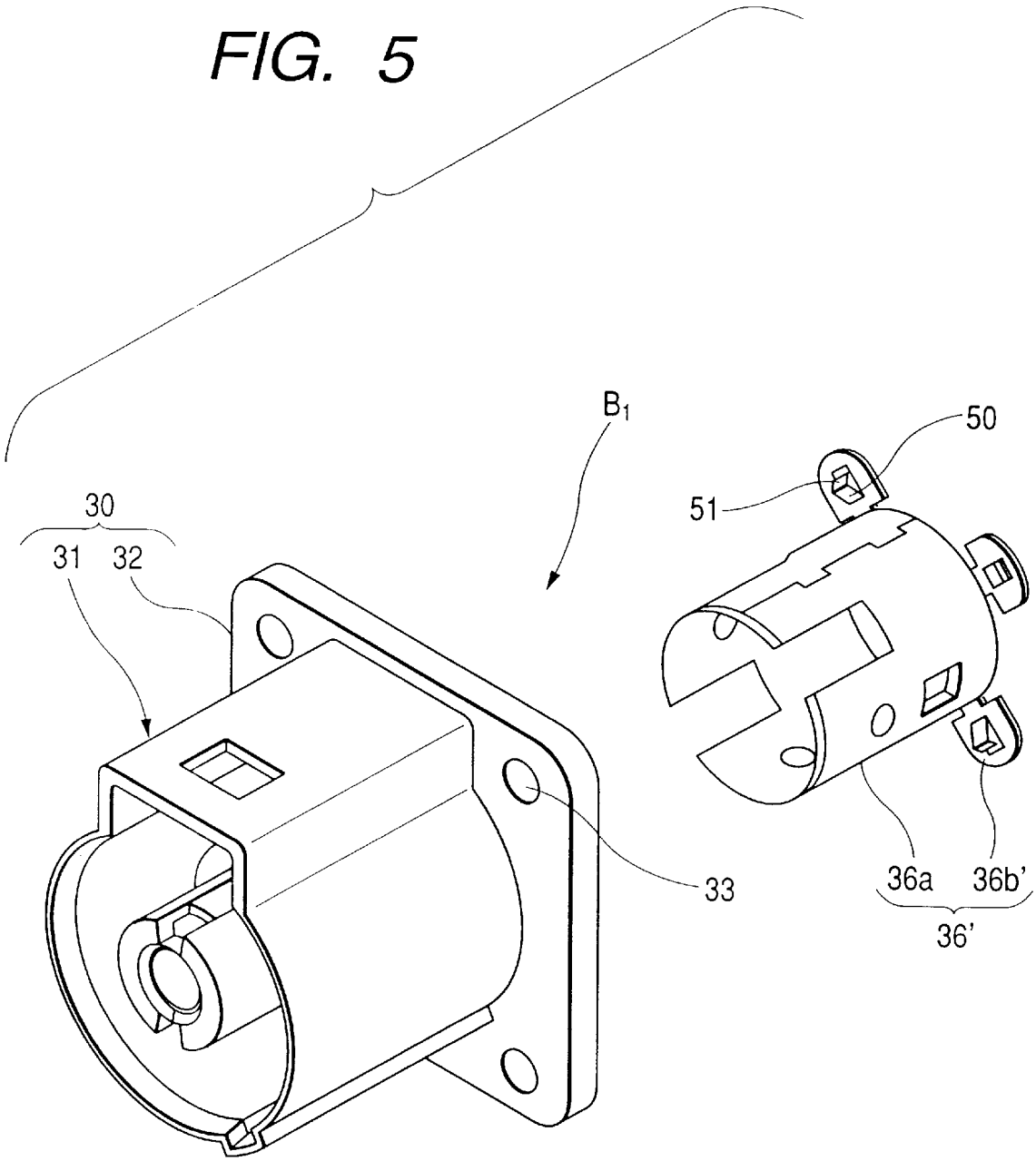
FIG. 5 is an exploded perspective view showing main portions of the shielded connector according to the second embodiment.
Figure 6:
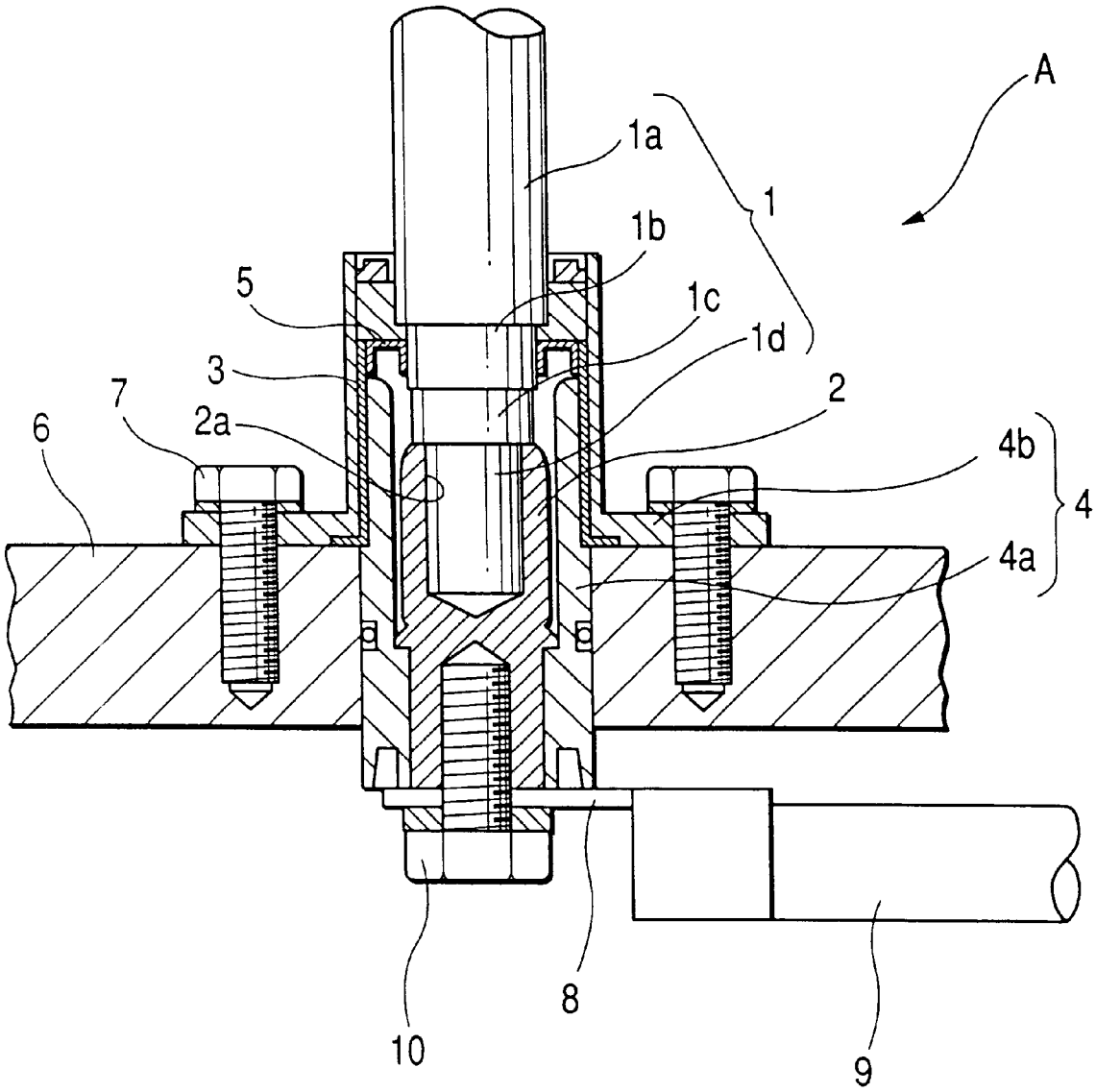
FIG. 6 PRIOR ART
FIG. 6 is a longitudinal section view showing a prior art example of a shielded connector adapted to be directly attached to an apparatus.
Figure 7:
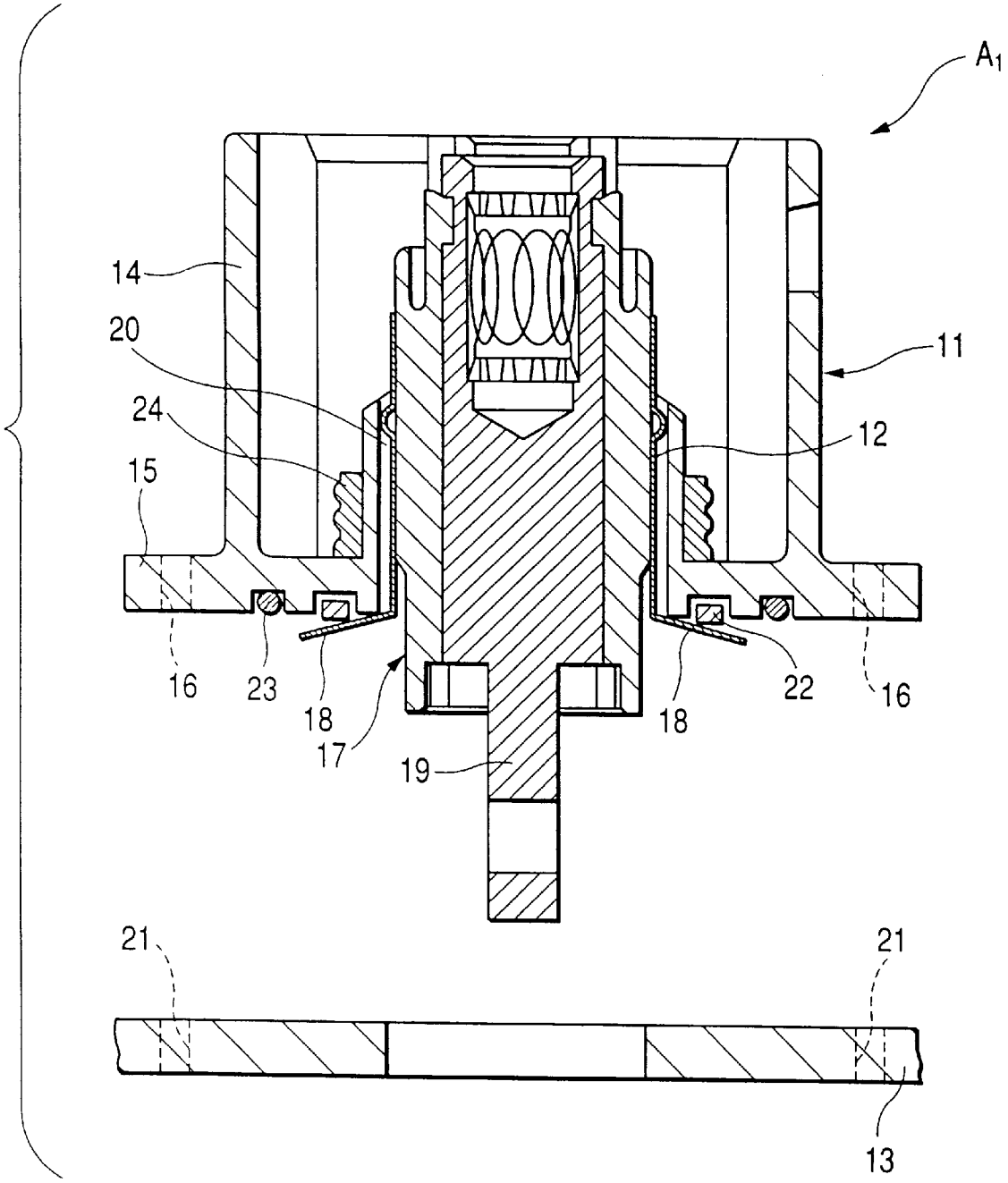
FIG. 7 PRIOR ART
FIG. 7 is a longitudinal section view showing another prior art example of a shielded connector adapted to be directly attached to an apparatus.
Figure 8:
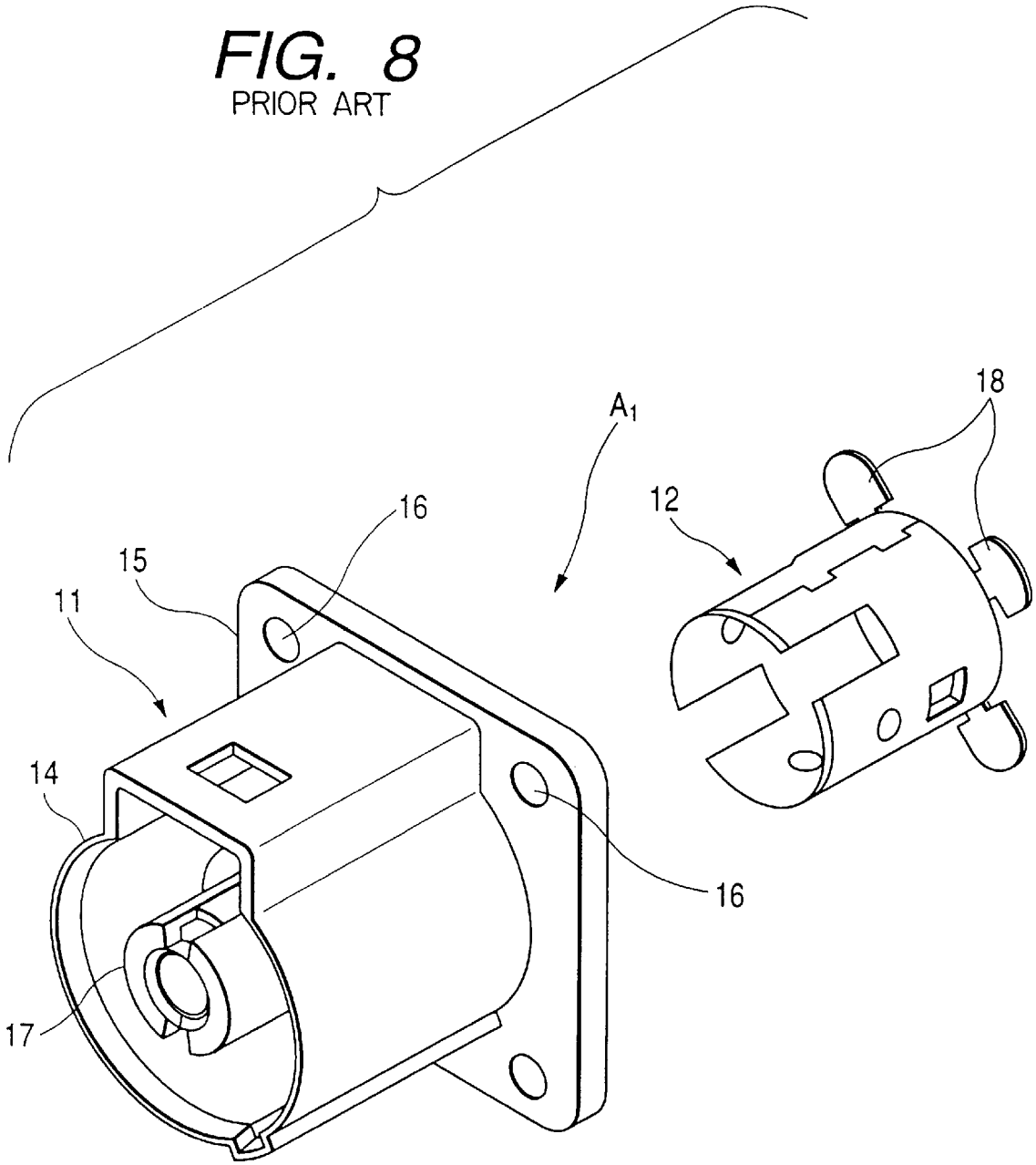
FIG. 8 PRIOR ART
FIG. 8 is an exploded perspective view showing main portions of the shielded connector of FIG. 7.

FIGS. 4 and 5 are a longitudinal section view of a shielded connector $B_1$ adapted to be directly attached to an apparatus according to a second embodiment of the invention, and an exploded perspective view of main portions of the shielded connector $B_1$, respectively.

The shielded connector $B_1$ adapted to be directly attached to an apparatus according to the second embodiment is identical with the shielded connector B of the first embodiment except that contact pieces 36*b*' of a metal shell 36' is different in configuration from the contact pieces 36*b* of the shielded connector B of the first embodiment. Therefore, components other than the contact pieces 36*b*' are designated by the same reference numerals as those of the first embodiment and their detailed description is omitted.

In each of the contact pieces 36*b*' which bendingly project from the end of the cylindrical portion 36*a* of the metal shell 36', the tip end is inclined toward the casing 13. An elastic contact portion 50 which is a spring piece formed by a slitting process is disposed in a substantially center area of the contact piece 36*b*'. A bent portion 51 is formed in a middle area of the elastic contact portion 50 so as to project from the elastic contact portion 50 toward the flange 32 (see FIG. 4).

The housing recess 45' which houses the contact pieces 36*b*' is disposed in the overlapping face of the casing 13.

In the same manner as the first embodiment, the housing recess 45' has a depth sufficient for housing the contact piece 36*b*' in which the elastic contact portion 50 is compressively deformed in an elastically returnable range.

In the second embodiment, the housing recess 45' is disposed in the casing 13. Alternatively, the housing recess may be disposed in the flange 32 instead of the casing 13, in the same manner as the first embodiment.

When the metal shell 36' is attached into the groove 37 of the connector housing 30, the elastic contact portion 50 is pressingly contacted with the overlapping face 32*a* of the flange 32.

When the flange 32 overlaps with the casing 13, the contact piece 36*b*' is pressingly contacted with the casing 13, and the elastic contact portion 50 which is clamped between the flange 32 and the casing 13 is deformed until it substantially flush with the contact piece 36*b*'.

The elastic contact portion 50 deforms in the elastically deformable range and permanent set does not occur. Therefore, the shield property is surely held for a long period of time, and, even when the connector is disassembled and reassembled, the holding state is not impaired.

Since the invention is configured as described above, the contact piece of the metal shell is pressingly contacted with a casing of an electric apparatus with elastic deformation within the elastic limit. Therefore, the shield property of the shield connector is surely maintained for a long period of time, and, even when the connector is disassembled and reassembled, the holding state is not impaired.

According to the invention, in the metal shell, the elastic contact portion can be formed during a pressing process in a part production step. Therefore, a shielded connector which is adapted to be directly attached to an apparatus and which has a shield property of high reliability can be produced at the same cost as a shield connector of the prior art.

What is claimed is:

1. A shielded connector adapted to be directly attached to a conductive casing of an electric apparatus, comprising:

a connector housing;

a terminal housing portion disposed in the connector housing;

a shielding metal shell disposed in the connector housing and surrounding the terminal housing portion;

a contact piece bendingly projected from the metal shell for electrically connecting with the conductive casing when the connector housing is attached to the conductive casing; p1 an elastic contact portion formed on an end portion of the contact piece, the elastic contact portion being compressively deformed by overlapping faces of the connector housing and the conductive casing, when the connector housing is attached to the conductive casing; and a recess for housing the contact piece when the connector housing is attached to the conductive casing, the recess formed on at least one of the overlapping faces of the connector housing and the conductive casing, the recess having a depth selected such that deformation of the elastic contact portion is elastically returnable.

2. The shielded connector adapted to be directly attached to an apparatus according to claim 1, wherein the elastic contact portion is a drawn product which is plastically deformed by applying a drawing process on the contact piece and the elastic contact portion has a convex side and a concave side so that a tip end of the elastic contact portion projects from the overlapping face of the connector housing by a predetermined amount.

3. The shielded connector adapted to be directly attached to an apparatus according to claim 1, wherein the elastic contact portion is a spring piece which is disposed in the contact piece, so as to bias the contact piece away from the connector housing after the connector housing and electric apparatus are detached, and wherein the spring piece deforms to be substantially flush with the contact piece when the connector housing is attached to the electric apparatus.

4. The shielded connector adapted to be directly attached to an apparatus according to claim 3, wherein the spring piece is a plate springs having a bent portion of the plate spring which is formed in a middle portion.

5. The shielded connector adapted to be directly attached to an apparatus according to claim 3, wherein the spring piece is formed from a slit section of the contact piece being folded so as to protrude from the face of the contact piece.

* * * * *